US009207015B2

(12) United States Patent
Ahn et al.

(10) Patent No.: US 9,207,015 B2
(45) **Date of Patent: *Dec. 8, 2015**

(54) DRYER HAVING EVAPORATOR EQUIPPED WITH SECOND CONDENSER

(71) Applicant: LG ELECTRONICS INC., Seoul (KR)

(72) Inventors: Seungphyo Ahn, Seoul (KR); Hyunwoo Noh, Seoul (KR); Hyuksoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 118 days.

This patent is subject to a terminal disclaimer.

(21) Appl. No.: 14/057,226

(22) Filed: Oct. 18, 2013

(65) Prior Publication Data

US 2014/0109426 A1 Apr. 24, 2014

(30) Foreign Application Priority Data

Oct. 22, 2012 (KR) ..... 10-2012-0117469

(51) Int. Cl.

| | |
|---|---|
| ***D06F 58/20*** | (2006.01) |
| ***F26B 21/08*** | (2006.01) |
| ***D06F 58/02*** | (2006.01) |
| *F25B 39/02* | (2006.01) |
| *F25B 39/04* | (2006.01) |

(52) U.S. Cl.

CPC ..... *F26B 21/086* (2013.01); *D06F 58/02* (2013.01); *D06F 58/206* (2013.01); *F25B 39/02* (2013.01); *F25B 39/04* (2013.01)

(58) Field of Classification Search

CPC ..... F26B 19/00; F26B 21/00; F26B 21/06; F26B 21/08; D06F 58/00; D06F 58/06; D06F 58/20

USPC ..... 34/73, 595, 601, 606, 610; 68/12.06, 68/19, 20; 8/132, 149

See application file for complete search history.

(56) References Cited

U.S. PATENT DOCUMENTS 3,290,793 A * 12/1966 Jacobs et al. ..... 34/76
7,020,985 B2 * 4/2006 Casey et al. ..... 34/595

(Continued)

FOREIGN PATENT DOCUMENTS

DE 4409607 A1 * 10/1994 ..... D06F 58/20
EP 0 999 302 * 2/2000

(Continued)

OTHER PUBLICATIONS

Russian Office Action issued in related Application No. 2013142950 dated Dec. 26, 2014 (with English translation).

(Continued)

*Primary Examiner* — Stephen M Gravini
(74) *Attorney, Agent, or Firm* — Ked & Associates, LLP

(57) ABSTRACT

A dryer is provided. The dryer may include a second condenser integrally provided with an evaporator and employing a heat pump to maximize a condensation effect so as to enhance heat exchange efficiency, thereby enhancing dehumidifying capability. The dryer may be a circulation type heat pump dryer including a cabinet, a drum, a drying duct to circulate dry air back to the drum, an evaporator having a heat pump, a first condenser, a compressor, an expansion apparatus, and a second condenser to condense refrigerant condensed by the first condenser again so as to supercool the refrigerant during the refrigerant cycle, thereby enhancing dehumidifying capability in the evaporator.

19 Claims, 5 Drawing Sheets

(56) References Cited

U.S. PATENT DOCUMENTS

| | | | | |
|---|---|---|---|---|
| 8,082,677 | B2 * | 12/2011 | Noviello | 34/60 |
| 8,418,377 | B2 * | 4/2013 | Grunert et al. | 34/86 |
| 8,601,717 | B2 * | 12/2013 | Beers et al. | 34/419 |
| 8,615,895 | B2 * | 12/2013 | Shin et al. | 34/82 |
| 8,707,581 | B2 * | 4/2014 | Quaroni et al. | 34/604 |
| 2005/0204755 | A1 * | 9/2005 | Nishiwaki et al. | 62/93 |
| 2012/0246962 | A1 | 10/2012 | Lee | |
| 2014/0041400 | A1 * | 2/2014 | Cavarretta | 62/79 |
| 2014/0109426 | A1 * | 4/2014 | Ahn et al. | 34/73 |
| 2014/0109428 | A1 * | 4/2014 | Kim et al. | 34/86 |
| 2014/0223758 | A1 * | 8/2014 | Bison et al. | 34/86 |

FOREIGN PATENT DOCUMENTS

| | | | |
|---|---|---|---|
| EP | 2573252 | A1 * | 3/2013 |
| WO | WO 2009059889 | A1 * | 5/2009 |
| WO | WO 2011/080116 | A1 | 7/2011 |
| WO | WO 2011/088116 | A1 | 7/2011 |
| WO | WO 2013/045363 | A1 | 4/2013 |

OTHER PUBLICATIONS

Russian Decision to Grant a Patent dated Mar. 25, 2015 issued in Application No. 2013142950 (with English translation).

* cited by examiner

DRYER HAVING EVAPORATOR EQUIPPED WITH SECOND CONDENSER

CROSS-REFERENCE TO RELATED APPLICATION(S)

This application claims priority under 35 U.S.C. §119 to Korean Application No. 10-2012-0117469 filed on Oct. 22, 2012, whose entire disclosure is hereby incorporated by reference.

BACKGROUND

1. Field

This relates to a dryer, and more particularly, to a dryer having enhanced dehumidifying power.

2. Background

In a laundry treating apparatus having a drying function such as a washer or dryer, once washing and dehydration are completed, hot air may be supplied into the drum to evaporate moisture from the laundry, thereby drying the laundry. Such a dryer may include a drum rotatably provided within a cabinet, a drive motor to drive the drum, a blower fan to blow air into the drum, and a heating device to heat air conveyed into the drum. The heating device may use, for example, high-temperature electric resistance heat generated using electric resistance, or combustion heat generated by combusting gas.

BRIEF DESCRIPTION OF THE DRAWINGS

The embodiments will be described in detail with reference to the following drawings in which like reference numerals refer to like elements wherein.

DETAILED DESCRIPTION

Embodiments described herein and configurations shown the drawings are exemplary embodiments only, and do not represent all of the technical concepts as broadly described herein. Rather, it is understood that there may be various equivalents and modification examples that may replace them at the time of application.

Dryers may be classified according to a method for processing the high temperature humid air discharged from the drum as a condensation (circulation) type dryer for condensing moisture contained in the high temperature humid air by cooling the air below the dew point temperature while it circulates, without discharging the high temperature humid air out of the dryer, or an exhaustion type dryer for directly discharging the high temperature humid air from the drum to the outside.

In the condensation type dryer, in order to condense air discharged from the drum, the air may be cooled below the dew point temperature and then heated by the heating device prior to being supplied to the drum again. Here, loss of heat energy contained in the air may be generated while being cooled down during the condensation process, and an additional heater or the like may further heat the air to a temperature required for drying.

In the exhaustion type dryer, the high temperature humid air is discharged to the outside and outside air at a normal (room) temperature is drawn in and heated to a required temperature level by the heating device. In particular, residual thermal energy contained in the high temperature air being discharged to the outside may be wasted, thereby reducing thermal efficiency.

A laundry treating apparatus for collecting energy to generate hot air and unused energy being discharged to the outside may increase energy efficiency, such as, for example, a laundry treating apparatus having a heat pump system. The heat pump system may include two heat exchangers, a compressor and an expansion apparatus, and energy contained in the discharged hot air may be reused to heat air being supplied to the drum, thereby increasing energy efficiency.

Specifically, in such a heat pump system, an evaporator may be provided at the exhaust side of the drum, and a condenser at an inlet side of the drum, and thus thermal energy may be transferred to refrigerant through the evaporator and then thermal energy contained in the refrigerant may be transferred to air conveyed into the drum, thereby generating hot air using waste energy. A heater for reheating air that has been heated while passing through the evaporator may also be provided.

However, in a dryer using this type of heat pump, the size of the condenser may be somewhat restricted due to a lack of space, thereby causing difficulty in achieving the desired condensation effect. Accordingly, heat exchange efficiency may be reduced and the cooling of refrigerant may not be properly carried out, thereby reducing dehumidifying capability.

Figure 1:
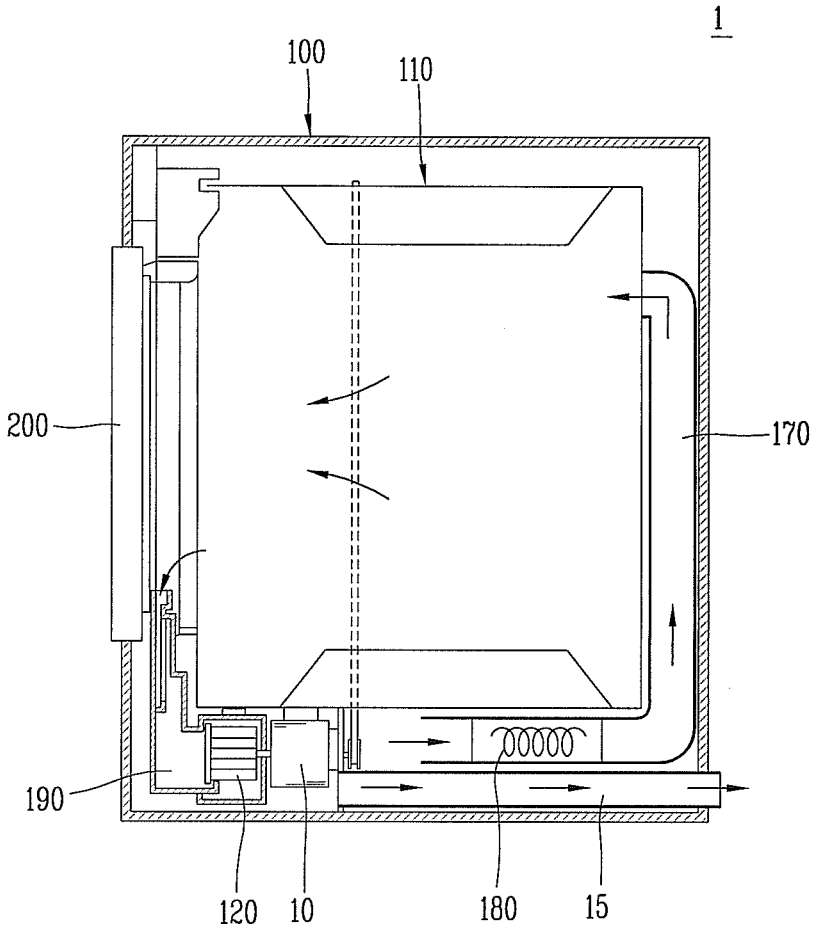
FIG. 1 is a side view of an internal structure of a heat pump type dryer.
Figure 2:
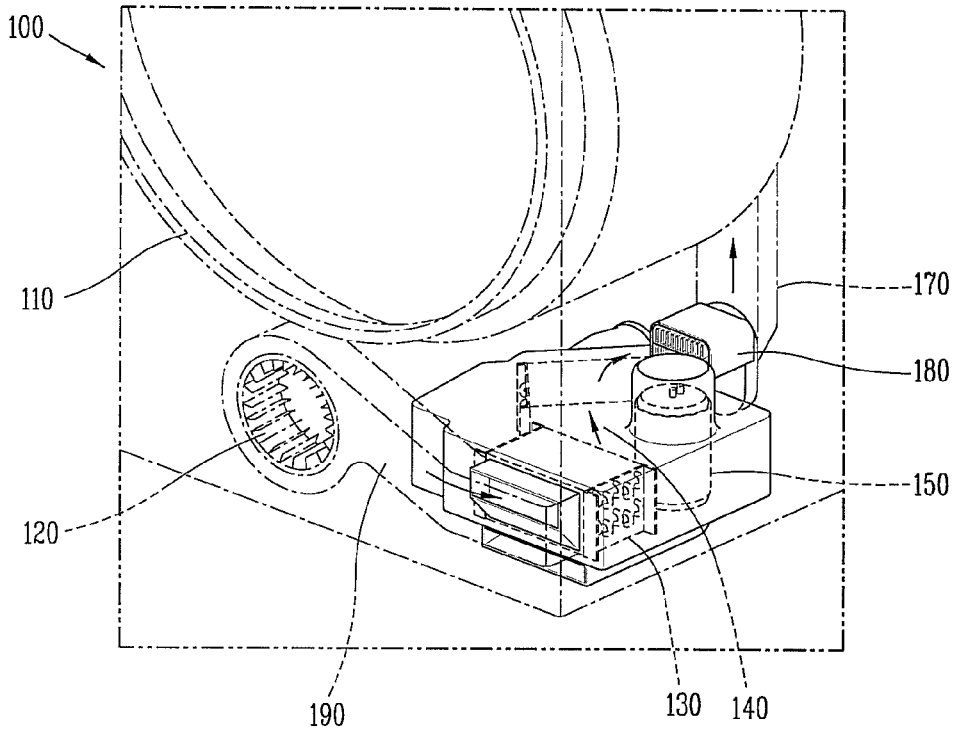
FIG. 2 is a partial detail view of a circulation type heat pump within the dryer shown in FIG. 1.
Figure 3:
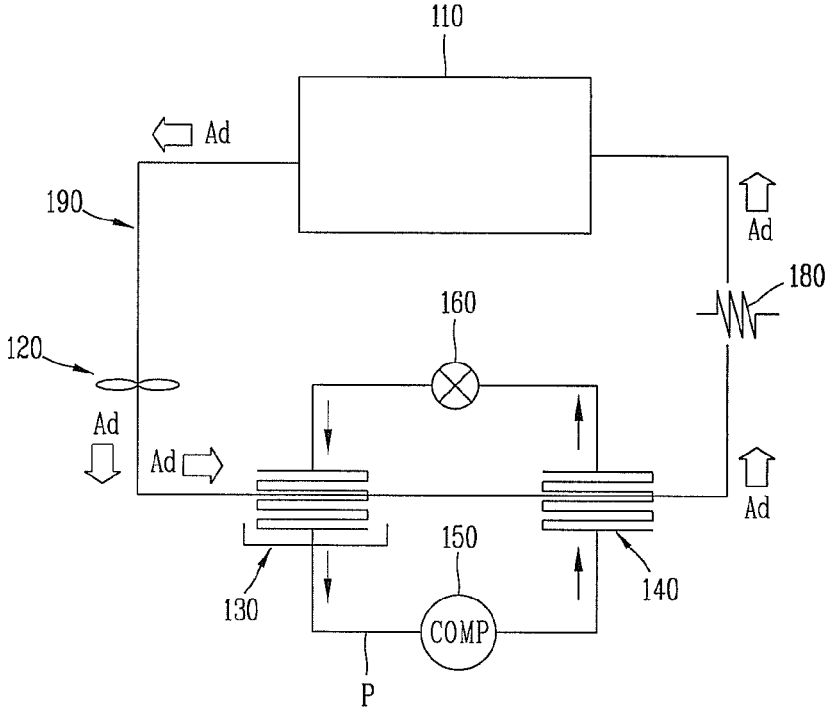
FIG. 3 is a schematic diagram of a drying method carried out by the heat pump shown in FIG. 2.

Referring to FIGS. 1 through 3, a dryer may include a cabinet 100 and a drum 110 rotatably provided within the cabinet 100. The drum 110 may be rotatably supported by a supporter, for example, at the front and rear ends thereof. An intake duct 170 may be provided in the cabinet 100 to draw outside air into the cabinet 100 and supply the air to the drum 110. The intake duct 170 may extend in the vertical direction at the rear of the drum 110, and may define an intake flow path. The air drawn in through the intake duct 170 may be drawn in from outside of the cabinet 100, separately from the drying duct 190. A heater 180 for heating the air to an adequate temperature for drying may be provided within the intake duct 170. The heater 180 may receive electrical energy to sufficiently and quickly supply heating to air to be supplied to the drum 110, and also so that the refrigerant cycle may be stably managed in a normal state.

When so configured, heating required for drying may be sufficiently supplied in a relatively short period of time, thereby reducing drying time. In other words, additional heating may be supplied in a short period of time when necessary to further heat the air flowing in the circulation flow path.

The air supplied to the drum 110 may be supplied through a circulation flow path formed in the drying duct 190, separately from the air provided through the intake flow path formed in the intake duct 170. The drying duct 190 may be provided in the cabinet 100 to circulate air discharged from the drum 110 back to the drum 110.

The air in the drum 110 dries/absorbs moisture from the laundry and then flows into a front surface duct located at a lower front side of the drum 110, and is supplied back to the drum 110 through the drying duct 190 by way of a lint filter, or is discharged to the outside of the cabinet 100 through an exhaust duct.

A blower fan 120 to forcibly blow air to the outside of the dryer may be provided on the circulation flow path formed by the drying duct 190.

An evaporator 130 and a condenser 140 may be sequentially provided on a flow path formed by the drying duct 190. The evaporator 130 and condenser 140, forming a kind of heat exchanger, may form a refrigerant cycle of the heat pump, thereby achieving heat exchange with air (Ad) on the circulation flow path.

The air supplied to the drum 110 may be heated by the heater 180 on the intake flow path or the condenser 140 on the circulation flow path to become high-temperature dry air at about 150-250° C. when supplied back into the drum 110. The high-temperature air may contact an object to be dried to evaporate moisture therefrom. The evaporated moisture will then be contained in intermediate temperature air exhausted out of the drum 110. The moisture may be removed from this intermediate temperature humid air so that it may be circulated and re-used. Since the moisture content in the air is affected by the temperature, the moisture may be removed by cooling the air. Accordingly, the air on the circulation flow path may be cooled by heat exchange with the evaporator 130. In order to supply the air cooled by the evaporator 130 back to the drum 110 at an appropriate temperature for drying, it may be heated by high temperature air, carried out by the condenser 140.

A refrigerant cycle may perform heat exchange with the environment using phase change(s) of refrigerant. Briefly described, refrigerant may be transformed into a low-temperature and low-pressure gas by absorbing heat from the environment in the evaporator, compressed into a high-temperature and high-pressure gas in the compressor, transformed into a high-temperature and high-pressure liquid by dissipating heat to the environment in the condenser, transformed into a low-temperature and low-pressure liquid by dropping its pressure in the expansion apparatus, and brought into the evaporator again. Due to the circulation of refrigerant, heat may be absorbed from the environment in the evaporator and heat may be supplied to the environment in the condenser. The refrigerant cycle may be also referred to as a heat pump.

Such a refrigerant cycle may include the compressor 150 and expansion apparatus 160 along with the evaporator 130 and condenser 140.

The flow path of air in heat exchange with the refrigerant cycle is illustrated in FIGS. 2 and 3. In other words, an arrow passing through the evaporator and condenser and a line connecting the evaporator and condenser does not indicate the flow path of the refrigerant. Rather, these arrows indicate the flow path of the air in FIGS. 2 and 3, which is sequentially brought into contact with the evaporator 130 and the like to perform heat exchange. As shown in FIG. 3, the evaporator 130 and condenser 140 may be sequentially disposed on the circulation flow path (a large circulation line formed along a bold arrow in FIG. 3) formed by the drying duct 190.

As illustrated in FIG. 3, the air (Ad) on the circulation flow path performs heat exchange with the heat pump during the refrigerant cycle, specifically the air (Ad) on the circulation flow path dissipates heat in heat exchange with the evaporator 130, and absorbs heat in heat exchange with the condenser 140. As a result, the air on the circulation flow path re-absorbs heat it has dissipated.

In general, the evaporator 130 and condenser 140 may mainly be in charge of heat exchange during the refrigerant cycle, and the air from which heat is taken in the evaporator 130 liquefies moisture contained therein to exhaust it as condensation water, so that dry air may be heated by the compressor 150 and condenser 140 to be changed into high temperature dry air. In this manner, the high-temperature air may be provided into the drum 110 along with the air from the intake flow path to perform the drying process. Part of the air provided to the drum and used in the drying process is exhausted to the outside of the dryer 100, and part is reused.

In a heat pump type dryer as embodied and broadly described herein, waste heat may be collected using the refrigerant cycle, without causing an overload during the refrigerant cycle. In other words, the heat exchange of refrigerant may be carried out by phase change(s) at optimal operating temperature and pressure, and to this end, a heat exchanger such as an evaporator and a condenser, a compressor, an expansion apparatus and the like may be used. Accordingly, in order to collect more heat, the size of the heat exchanger or compressor may be increased. However, due to limited installation space in the dryer, the size of these components may be somewhat limited.

Accordingly, the heater 180 may be provided within the intake duct 170 to continuously replenish the inhaled air with heating. According to embodiments as broadly described herein, heating may be replenished by the heater 180 to sufficiently supply the heating required for drying, thereby reducing drying time. Furthermore, the heat exchange of refrigerant may be carried out by phase change(s) at optimal operating temperature(s) and pressure(s), and to this end, heating may be sufficiently supplied. Otherwise, it may cause a problem such as refrigerant being supplied to the compressor in a liquid phase or the like, and thus the cycle cannot be stably operated, thereby reducing the reliability of the cycle. Accordingly, as disclosed herein, the air provided to the drum may be additionally replenished with heating by the heater 180, and thus the refrigerant cycle may be stably operated in a normal state.

Figure 4:
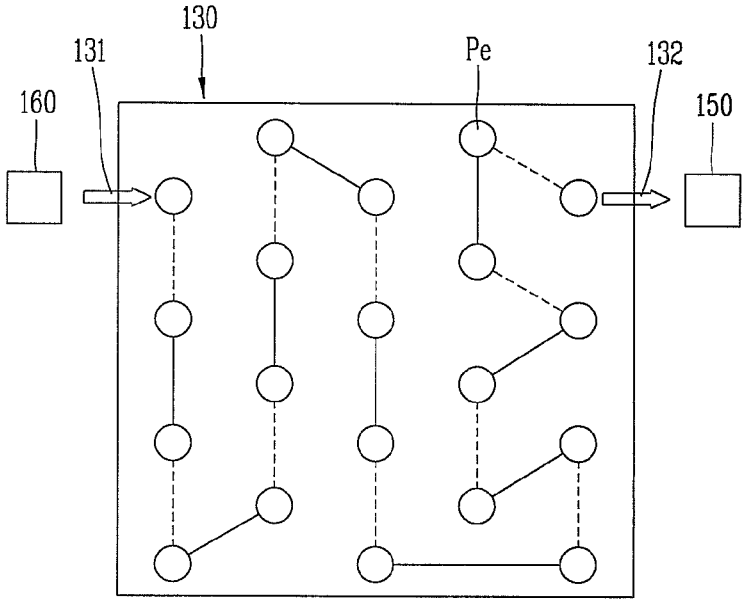
FIG. 4 illustrates a refrigerant circulation path of an evaporator in an exemplary heat pump.

In certain embodiments, the additional blower fan 120 may be provided on the intake flow path to provide more airflow, and prevent the heater 180 from overheating, as shown in FIGS. 2 through 4.

In certain embodiments, part of the air may be exhausted to the outside of the cabinet 100 upstream of the evaporator 130 on the circulation flow path. Accordingly, as illustrated in FIG. 1, the laundry treating apparatus may further include an exhaust duct 15 branched from the drying duct 190, upstream of the evaporator 130 and may exhaust part of the air to the outside of the cabinet 100. The exhaust duct 15 may form an exhaust flow path for discharging hot air coming out of the drum 110 to the outside.

According to the foregoing configuration, waste heat may be absorbed from part of the intermediate temperature humid air coming out of the drum 110 within a range that can be processed by the refrigerant cycle, and the rest of the air is exhausted. Accordingly, energy waste may be reduced overload during the refrigerant cycle may be avoided. Furthermore, it may be possible to reduce power consumption as well as enhance reliability.

Hereinafter, a heat pump type dryer including a second, or auxiliary, condenser installed in the evaporator to maximize a condensation effect, will be described with reference to FIGS. 4 through 7.

The exemplary evaporator 130 shown in FIG. 4 is formed on a single refrigerant path with one inlet 131 and one outlet 132, and the pipe line Pe of the evaporator may pass through a plurality of overlapped plate shaped heat dissipation fins and may extend vertically in a zigzag pattern. Refrigerant flowing into the evaporator 130 through the inlet 131 from the expansion apparatus 160 flows along the refrigerant line of the evaporator 130 to perform heat exchange, and is then circulated to the compressor 150 through the outlet 132 of the refrigerant pipe of the evaporator 130.

In such a refrigerant cycle, the evaporator 130 merely performs a heat exchange operation with high temperature and humid air in the dryer to reduce the temperature of the air and extract condensation water. Furthermore, air flowing through the condenser 140 is heated to allow the high temperature and humid air to flow back into the drum 110. Due to this, in a dryer as embodied and broadly described herein, the condenser 140 may function as a first condenser 140, and a second condenser 141 may be provided in the evaporator 130 to further increase a heating change, thereby enhancing heat exchange efficiency.

During the refrigerant cycle, refrigerant follows a path through the compressor 150, the first condenser 140, expansion apparatus 160 and the evaporator 130. In this embodiment, refrigerant that has passed through the compressor 150 is condensed in the first condenser 140, and then condensed again in the second condenser 141 separately provided in the evaporator 130, thereby enhancing a condensation effect.

Figure 5:
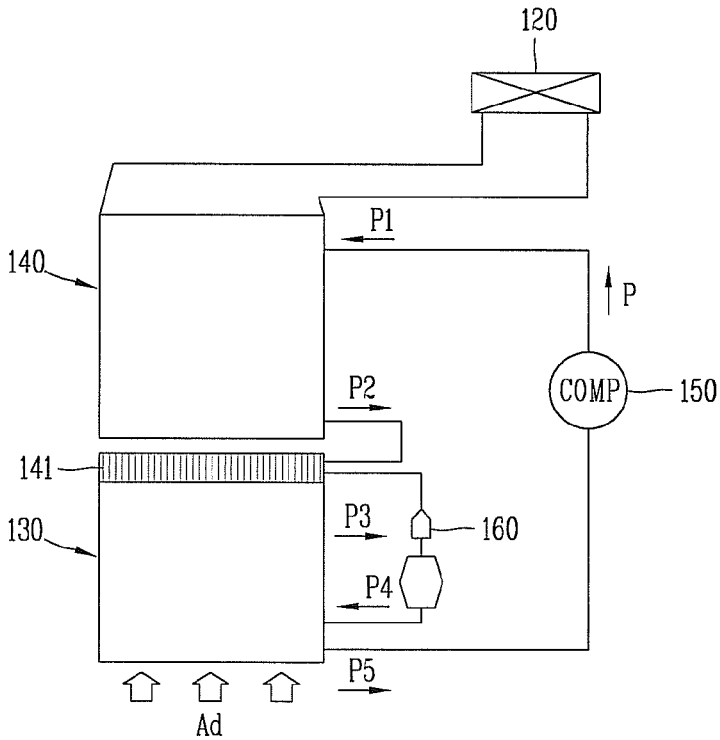
FIG. 5 is a schematic diagram of a circulation path of refrigerant using an additional condenser integrated with an evaporator, in accordance with embodiments as broadly described herein.

Referring to FIG. 5, the evaporator 130 may include the second condenser 141 configured to condense refrigerant (P2) that has already been condensed in the first condenser 140. Refrigerant (P4) condensed again in the second condenser may be is circulated to the expansion apparatus 160. Furthermore, refrigerant (P4) coming out of the expansion apparatus 160 may be circulated along the refrigerant pipe of the evaporator 130 to supercool refrigerant during the refrigerant cycle, thereby enhancing dehumidifying capability in the evaporator 130. Next, refrigerant (P5) coming through the evaporator 130 may pass through the compressor 150, and the compressed refrigerant (P1) flows to the refrigerant pipe of the condenser 140 again.

Figure 6:
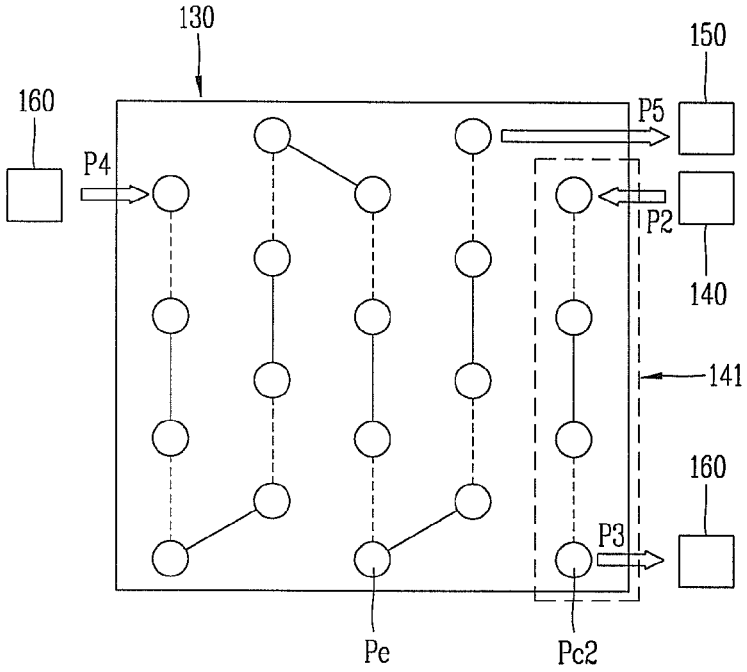
FIGS. 6 and 7 illustrate a refrigerant circulation path in an evaporator and an additional condenser integrated with an evaporator, in accordance with embodiments as broadly described herein.

In certain embodiments, as illustrated in FIGS. 5 and 6, the refrigerant pipe of the evaporator 130 and the refrigerant pipe of the second condenser 141 may be intrusively formed in the same heat dissipation fins.

The heat dissipation fin may be formed such that a plurality of plate-shaped metals having excellent thermal conductivity overlap with one another to efficiently perform external heat exchange with the refrigerant flowing through the refrigerant pipe. In this manner, a degree of supercooling may be further increased through the first condensation carried out by the first condenser 140 and the second condensation carried out by the second condenser 141 to enhance dehumidifying capability in the evaporator 130, thereby enhancing the efficiency of the heat pump.

The refrigerant cycle in a condensation type dryer having a heat pump, as embodied and broadly described herein, may enhance dehumidifying capability in the evaporator 130 for removing moisture in the dry flow path. To this end, refrigerant flowing into the pipe from the first condenser 140 outlet passes through the second condenser 141 without directly passing through the expansion apparatus 160. Accordingly, it has a structure in which refrigerant in the second condenser 141 may be further supercooled and brought into the evaporator 130 in a low temperature dry state through the expansion apparatus 160, thereby enhancing dehumidifying capability.

Figure 7:
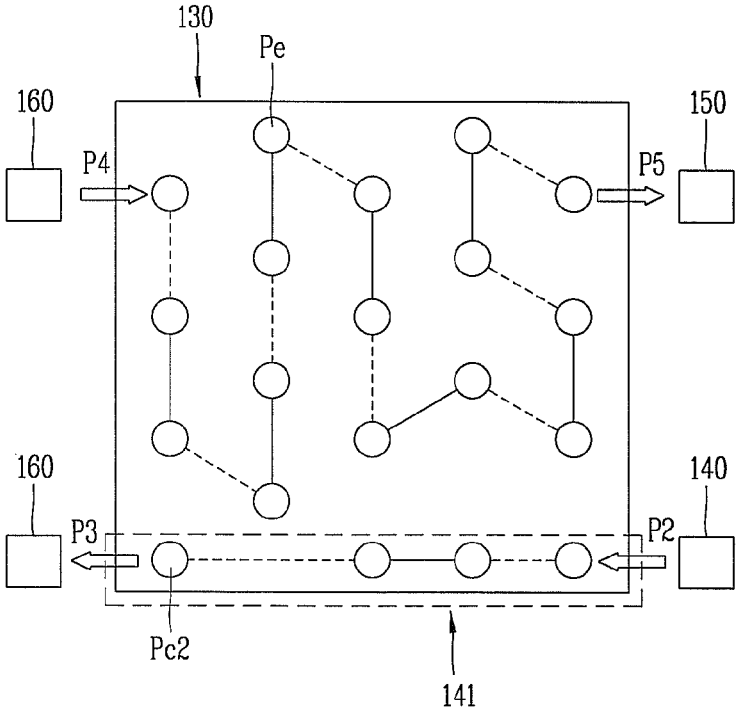

The second condenser 141 may be vertically arranged at the rear end, or downstream end, of the evaporator 130, or horizontally arranged at the lower bottom end thereof, as illustrated in FIGS. 6 and 7, respectively, which illustrate the refrigerant flow path structure of an evaporator in which a partial refrigerant plumbing pipe of the evaporator 130 is independently plumbed in place of the second condenser 141.

As shown in FIG. 6, the refrigerant pipe of the evaporator 130 may be vertically arranged in a zigzag pattern, and the lowest end portion of the refrigerant pipe may be disposed at a condensation water line of condensation water accumulated below the evaporator 130, at a bottom of the drying duct 190, and the refrigerant pipe Pc2 of the second condenser 141 may be vertically arranged in a zigzag pattern at the rear end with respect to the flow direction of dry air, or downstream end.

The disposition and arrangement of the pipe plumbing of the second condenser 141 may maximize heat exchange efficiency by causing air to first pass through the second condenser 141 and then pass through the first condenser 140 since the moisture is removed and the temperature is reduced while high temperature and humid air (Ad) first passes through the evaporator 130.

In certain embodiments, the refrigerant pipe plumbing path of the evaporator 130 is configured with one path, and the refrigerant pipe plumbing path of the second condenser 141 is formed with an independent refrigerant line separated from the plumbing flow path of the evaporator 130.

For example, the refrigerant pipe plumbing path of the evaporator 130 may include one path vertically arranged in a zigzag pattern in four columns, and the refrigerant pipe plumbing path of the second condenser 141 may include one path vertically arranged in a zigzag pattern in one column, as shown in FIG. 6. In particular, FIG. 6 illustrates a structure in which the front, or upstream, end (left side in the drawing) first through fourth columns of the evaporator 130 is used for the evaporator plumbing performing refrigerant dehumidification and air cooling portions, and the last, fifth, column of the rear, or downstream, end (right side in the drawing) is used for the plumbing of the second condenser 141 to increase the degree of supercooling of the refrigerant.

In this arrangement, refrigerant may be evaporated in the evaporator plumbing (first through fourth columns from the front end) to transfer the heat of vaporization to external high temperature and humid air (Ad), thereby allowing moisture in the air to be cooled into condensation water. Accordingly, dry air at ambient temperature that has passed through the evaporator 130 may be heat transferred to the second condenser 141 through condenser refrigerant in a portion (the fifth column, at the rear end) used for the second condenser 141, thereby increasing the degree of supercooling of the refrigerant due to the second condenser 141.

According to another embodiment illustrated in FIG. 7, the refrigerant pipe plumbing path of the evaporator 130 may be vertically arranged in a zigzag pattern, and the refrigerant pipe plumbing path Pc2 of the second condenser 141 may be arranged so that it is submerged under condensation water below a condensation water line at a lower portion of the evaporator 130, and horizontally arranged in a zigzag pattern. In a structure in which a lower portion of the evaporator 130 forms the second condenser 141, the heat of vaporization at an upper portion of the evaporator 130 may be transferred and then the generated condensation water may flow down due to gravity since the second condenser 141 is provided at the lower portion, thereby increasing the degree of supercooling due to a temperature difference between condensation water and refrigerant while passing through the second condenser 141.

Hereinafter, enhanced dehumidifying performance in an evaporator including a second condenser as discussed above will be described in detail with reference to FIGS. 6 through 8.

As discussed above, the first condenser 140 which is a heat pump system, the second condenser 141, the expansion apparatus 160, the evaporator 130 and the compressor 150 are connected to circulate refrigerant along a refrigerant circulation line so as to form a refrigerant cycle. Furthermore, as illustrated in the graph of FIG. 8, the refrigerant cycle may perform a second condensing operation on refrigerant (P2) coming out of the first condenser 140 through the second condenser 141 to increase the degree of supercooling of the refrigerant (P3) coming out of the second condenser 141 by ΔQ. In other words, the enthalpy of refrigerant (P3) coming out of the second condenser 141 may be less than that of refrigerant (P2) coming out of the first condenser 140.

The dehumidifying performance of the evaporator 130 may be enhanced by approximately 400 W during the refrigerant cycle due to a difference (ΔQ) between the enthalpy of refrigerant (P2) coming out of the first condenser 140 and the enthalpy of refrigerant (P3) coming out of the second condenser 141.

Figure 8:
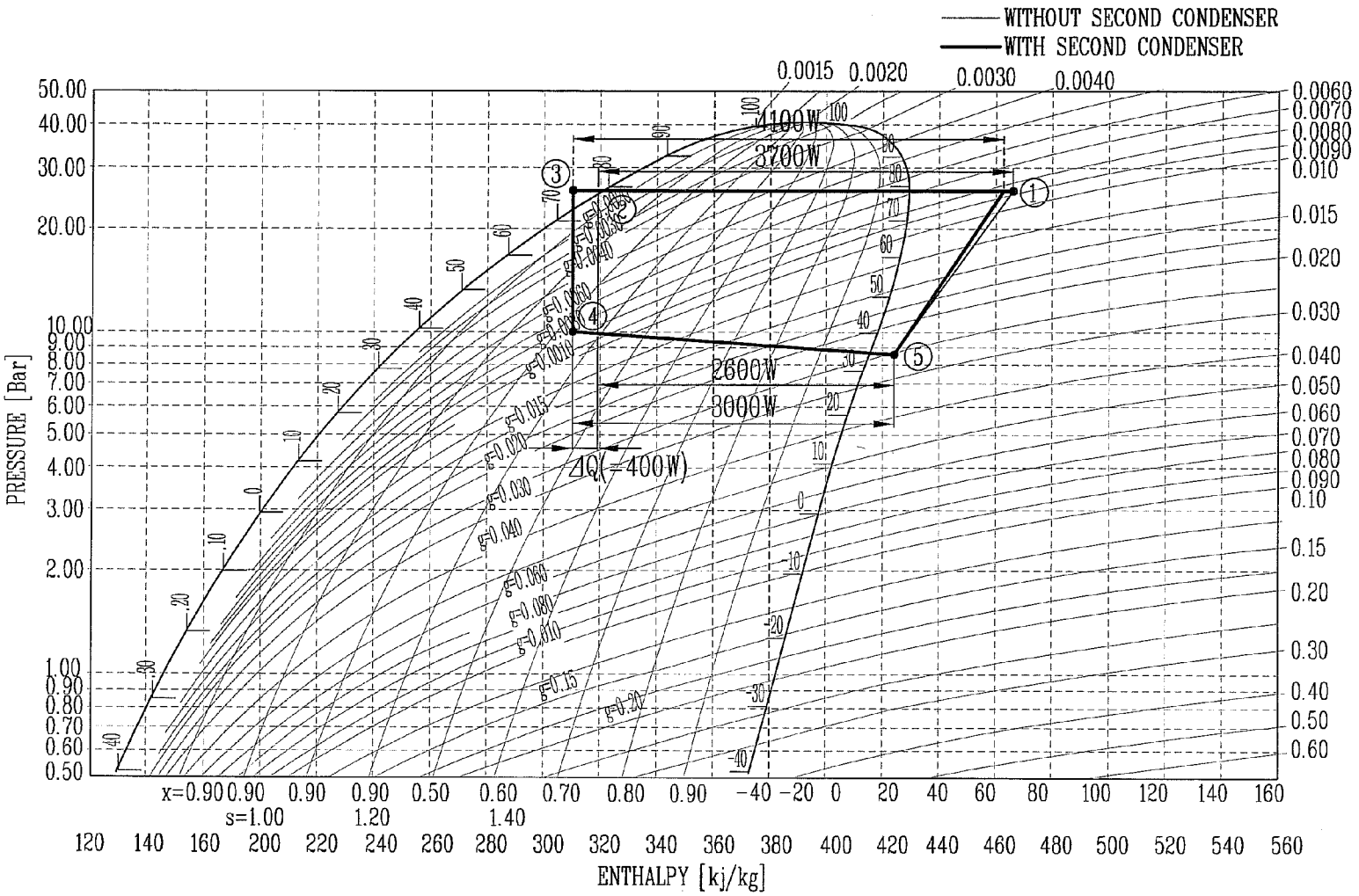
FIG. 8 is a graph showing enhanced dehumidifying performance according to enhanced heat exchange efficiency.

As shown in FIG. 8, first, when performing a first condensation operation in the condenser 140 at the state (1) which is a phase of refrigerant (P1) coming out of the compressor 150, the refrigerant is phase-changed to the state (2) (refrigerant in the phase of P2). Then, a degree of supercooling using the second condenser 141 according to the present disclosure is increased to the location of (3) (refrigerant in the phase of P3) from that of (2) (refrigerant in the phase of P2). Accordingly, a heat absorption start location in the evaporator 130 is moved to the location of (4) (P4), and thus it is seen that the dehumidifying performance is enhanced from 2600 W (in a system not employing such a second condenser) to 3000 W, from enthalpy (4) to enthalpy (5), by about 400 W.

In a laundry treating apparatus as embodied and broadly described herein, the second condenser 141 may be integrally added to the evaporator 130 to supercool refrigerant in the refrigerant cycle and maximize a condensation effect, thereby enhancing heat exchange efficiency.

Furthermore, the second condenser 141 may be positioned along a path separated from the refrigerant line of the evaporator 130, thereby enhancing dehumidifying performance by about 400 W due to condensation water cooling providing enhanced heat exchange efficiency.

A dryer is provided, the dryer employing a circulation type heat pump in which a second condenser is integrally added to an evaporator to supercool refrigerant in the refrigerant cycle and maximize a condensation effect, thereby enhancing heat exchange efficiency.

A dryer is provided, the dryer employing a heat pump structure in which a second condenser is configured through a path separated from the refrigerant line of the evaporator, in the rear heat or lower heat of the evaporator, thereby promoting heat exchange efficiency enhanced through cool dry air or lower condensation water, and enhancing dehumidifying performance by about 400 W.

A heat pump type dryer as embodied and broadly described herein may include a cabinet, a drum rotatably provided within the cabinet, a drying duct provided in the cabinet to circulate air discharged from the drum by resupplying it thereto, an evaporator and a first condenser sequentially provided on a flow path formed by the drying duct, and a compressor and an expansion apparatus configured to form a refrigerant cycle along with the evaporator and the first condenser.

The evaporator may include a second condenser to condense refrigerant condensed from the first condenser again, and the refrigerant pipe of the evaporator and the refrigerant pipe of the second condenser may be intrusively formed in the same heat dissipation fins to supercool refrigerant during the refrigerant cycle, thereby enhancing dehumidifying capability in the evaporator.

Furthermore, the refrigerant pipe of the evaporator and the refrigerant pipe of the second condenser may be intrusively formed in the same heat dissipation fins.

In certain embodiments, the refrigerant pipe of the evaporator may be vertically arranged in a zigzag pattern, and the lowest end portion of the refrigerant pipe may be disposed on the condensation water line, and the refrigerant pipe of the second condenser may be vertically arranged in a zigzag pattern at the rear side with respect to the flow direction of dry air.

In certain embodiments, the refrigerant pipe plumbing path of the evaporator may be configured with one path, and the refrigerant pipe plumbing path of the second condenser may be formed with an independent refrigerant line separated from the pluming flow path of the evaporator.

In certain embodiments, the refrigerant pipe plumbing path of the evaporator may be formed with one path vertically arranged in a zigzag pattern with four columns, and the refrigerant pipe plumbing path of the second condenser may be formed with one path vertically arranged in a zigzag pattern with one column.

According to another embodiment as broadly described herein, the refrigerant pipe plumbing path of the evaporator may be vertically arranged in a zigzag pattern, and the refrigerant pipe plumbing path of the second condenser may be disposed to be submerged under condensation water below a condensation water line at a lower portion of the evaporator, and horizontally arranged in a zigzag pattern.

In certain embodiments, the first condenser, the second condenser, the expansion apparatus, the evaporator and the compressor may be connected to circulate refrigerant along a refrigerant circulation line so as to form a refrigerant cycle.

Furthermore, the refrigerant cycle may perform a second condensing operation on refrigerant (P2) coming out of the first condenser through the second condenser to increase the supercooling degree of refrigerant (P3) coming out of the second condenser.

As a result, the enthalpy of refrigerant (P3) coming out of the second condenser may be less than that of refrigerant (P2) coming out of the first condenser.

When so configured, the dehumidifying performance of the evaporator may be enhanced by 400 W during the refrigerant cycle due to a difference (ΔQ) between the enthalpy of refrigerant (P2) coming out of the first condenser and the enthalpy of refrigerant (P3) coming out of the second condenser.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dryer, comprising:

a cabinet;

a drum rotatably provided within the cabinet;

a drying duct provided in the cabinet to circulate sir discharged from the drum back into the drum;

an evaporator and a first condenser sequentially provided on a flow path formed by the drying duct, the evaporator comprising a plurality of heat dissipation fins;

a compressor and an expansion apparatus configured to form a refrigerant cycle together with the evaporator and the first condenser; and a second condenser configured to receive refrigerant condensed by the first condenser and to condense the received refrigerant again, wherein the second condenser is installed in the evaporator.

2. The dryer of claim 1, wherein the refrigerant pipe of the second condenser is arranged at a downstream end of the evaporator.

3. The dryer of claim 2, wherein the refrigerant pipe of the evaporator forms a first path, and the refrigerant pipe of the second condenser is independent from the refrigerant pipe of the evaporator and forms a second path that is separated from the first path of the evaporator.

4. The dryer of claim 2, wherein the refrigerant pipe of the evaporator is arranged in a vertical zigzag pattern, and a lowest end portion of the refrigerant pipe of the evaporator is disposed corresponding to a condensation water line of condensation water accumulated below the evaporator, and wherein the refrigerant pipe of the second condenser is arranged in a vertical zigzag pattern.

5. The dryer of claim 3, wherein the refrigerant pipe of the evaporator is arranged in a vertical zigzag pattern, and a lowest end portion of the refrigerant pipe of the evaporator is disposed corresponding to a condensation water line of condensation water accumulated below the evaporator, and wherein the refrigerant pipe is arranged in a vertical zigzag pattern.

6. The dryer of claim 2, wherein the refrigerant pipe of the evaporator forms a first path arranged in a vertical zigzag pattern having four columns, and the refrigerant pipe of the second condenser forms a second path arranged in a vertical zigzag pattern having one column.

7. The dryer of claim 3, wherein the refrigerant pipe of the evaporator forms a first path arranged in a vertical zigzag pattern having four columns, and the refrigerant pipe of the second condenser forms a second path arranged in a vertical zigzag pattern having one column.

8. The dryer of claim 1, wherein the refrigerant pipe of the second condenser is configured to be submerged below a condensation water line of condensation water accumulated below the evaporator.

9. The dryer of claim 8, wherein the refrigerant pipe of the evaporator is arranged in a vertical zigzag pattern, and the refrigerant pipe of the second condenser is arranged in a horizontal zigzag pattern.

10. The dryer of claim 1, wherein the first condenser, the second condenser, the expansion apparatus, the evaporator and the compressor are connected to circulate refrigerant along a refrigerant circulation line so as to form a refrigerant cycle.

11. The dryer of claim 10, wherein the refrigerant cycle performs a first condensing operation on refrigerant in the first compressor, and then performs a second condensing operation on refrigerant received from the first condenser to increase a degree of supercooling degree of refrigerant provided by the refrigerant cycle through the second condenser.

12. The clothes dryer of claim 11, wherein anenthalpy level of refrigerant coming out of the second condenser is less than that of refrigerant coming out of the first condenser.

13. The clothes dryer of claim 12, wherein a difference between the enthalpy level of refrigerant coming out of the first condenser and the enthalpy level of refrigerant coming out of the second condenser generates an increase in dehumidifying performance of the evaporator of approximately 400 W.

14. A dryer, comprising:

a cabinet;

a drum rotatably provided within the cabinet;

a drying duct provided in the cabinet and connecting an exhaust port and an inlet port of the drum; and an evaporator and a first condenser sequentially provided on a flow path formed by the drying duct, wherein the evaporator comprises:

a first refrigerant pipe arranged on at least one of a plurality of heat dissipation fins of the evaporator and forming a first flow path for refrigerant flowing through the evaporator;

a second condenser configured to receive refrigerant condensed by the first condenser and to condense the received refrigerant again; and a second refrigerant pipe arranged on the at least one of the plurality of heat dissipation fins and forming a second flow path for refrigerant flowing through the second condenser, wherein the first refrigerant pipe forms a zigzag pattern arranged in a plurality of vertical columns.

15. The dryer of claim 14, wherein the second refrigerant pipe is positioned at a downstream end of the evaporator, and downstream of the first refrigerant pipe.

16. The dryer of claim 15, wherein the second refrigerant pipe forms a zigzag pattern arranged in one vertical column, downstream of the plurality of vertical columns formed by the first refrigerant pipe.

17. The dryer of claim 14, wherein the second refrigerant pipe forms a zigzag pattern arranged in one horizontal row, below the plurality of vertical columns of formed by the first refrigerant pipe.

18. The dryer of claim 17, wherein the second refrigerant pipe is configured to be positioned below a top surface of condensation water accumulated below the evaporator.

19. The dryer of claim 1, wherein a refrigerant pipe of the evaporator and a refrigerant pipe of the second condenser are formed in the same heat dissipation fins.

* * * * *